US011512916B2

(12) United States Patent
Reynolds et al.

(10) Patent No.: US 11,512,916 B2
(45) Date of Patent: Nov. 29, 2022

(54) RATE CONTROL MECHANISM FOR FULLY AUTOMATIC FIREARMS

(71) Applicants: George L. Reynolds, Altona, IL (US); S. Paul Reynolds, Galesburg, IL (US)

(72) Inventors: George L. Reynolds, Altona, IL (US); S. Paul Reynolds, Galesburg, IL (US)

( * ) Notice: Subject to any disclaimer, the term of this patent is extended or adjusted under 35 U.S.C. 154(b) by 0 days.

(21) Appl. No.: 17/192,284

(22) Filed: Mar. 4, 2021

(65) Prior Publication Data

US 2021/0348867 A1 Nov. 11, 2021

Related U.S. Application Data

(63) Continuation of application No. PCT/US2019/049524, filed on Sep. 4, 2019.

(60) Provisional application No. 62/727,794, filed on Sep. 6, 2018.

(51) Int. Cl.
*F41A 19/44* (2006.01)
*F41A 19/55* (2006.01)

(52) U.S. Cl.
CPC ..... *F41A 19/44* (2013.01); *F41A 19/55* (2013.01)

(58) Field of Classification Search
CPC ..... F41A 19/31; F41A 19/44; F41A 19/55; F41A 19/03; F41A 19/04; F41A 19/45
USPC ..... 89/131
See application file for complete search history.

(56) References Cited

U.S. PATENT DOCUMENTS 2,748,661 A 6/1956 Simpson
2,791,942 A * 5/1957 Fletcher ..... F41A 19/03 89/131
2,873,650 A * 2/1959 Pinkerton, Jr. ..... F41A 19/03 89/131
2,995,988 A * 8/1961 Reed ..... F41A 19/31 89/129.01
3,650,177 A * 3/1972 Hupp ..... F41A 19/03 89/198
3,670,442 A 6/1972 Kennedy et al.
3,724,325 A * 4/1973 Silsby ..... F41A 19/03 89/142
4,028,993 A 6/1977 Reynolds
4,523,509 A * 6/1985 Thevis ..... F41A 19/03 89/131
5,379,677 A * 1/1995 Ealovega ..... F41A 3/90 89/130
5,485,776 A * 1/1996 Ealovega ..... F41A 19/03 89/135
5,623,114 A 4/1997 Soper
5,770,814 A * 6/1998 Ealovega ..... F41A 19/04 89/131
6,976,416 B2 12/2005 Ealovega
(Continued)

FOREIGN PATENT DOCUMENTS

WO 97021974 6/1997

OTHER PUBLICATIONS

International Search Report and Written Opinion, PCT Appln. No. PCT/US/19/49524, dated Aug. 3, 2020, 10 pgs.

*Primary Examiner* — Bret Hayes
(74) *Attorney, Agent, or Firm* — Taft, Stettinius & Hollister LLP

(57) ABSTRACT

A rate reducer is provided that can be employed in a firearm capable of fully automatic fire to reduce the cyclic rate of firing. The rate reducer can be employed in newly manufactured firearms or in existing firearms by replacing the conventional automatic sear of the firearm with the rate reducer.

20 Claims, 17 Drawing Sheets

(56) References Cited

U.S. PATENT DOCUMENTS

| | | | | |
|---|---|---|---|---|
| 8,899,141 | B2 | 12/2014 | Reynolds et al. | |
| 2014/0230642 | A1* | 8/2014 | Reynolds | F41A 3/78 89/130 |

* cited by examiner

RATE CONTROL MECHANISM FOR FULLY AUTOMATIC FIREARMS

CROSS-REFERENCE TO RELATED APPLICATIONS

The present application is a continuation of International Patent Application No. PCT/US19/49524 filed on Sep. 4, 2019, which claims the benefit of the filing date of U.S. Provisional Application Ser. No. 62/727,794 filed on Sep. 6, 2018, each of which are incorporated herein by reference.

BACKGROUND

All self-powered machine guns and fully automatic firearms have a natural cyclic rate of fire. The cyclic rate of a machine gun is usually expressed as a number of shots-per-minute (spm). In practice, machine guns are seldom fired continuously for one minute, but "spm" is a convenient and universally understood expression used by those familiar with the art.

Most shoulder-fired fully automatic firearms such as some of the M16 family of weapons, including the US M4 5.56 mm Carbine, have such high natural cyclic rates of fire that the rapidly delivered recoil impulses cause the weapon to move off target more or less uncontrollably. This not only reduces hit probability per shot, but wastes ammunition, overheats and rapidly wears out barrels, and reduces "trigger time" for the ammunition available in the magazine or belt. In most cases this pervasive uncontrollability is simply tolerated and/or somewhat ameliorated by training soldiers to fire short bursts, or by incorporating burst limiters.

The M16 family of weapons possesses a natural cyclic rate of fire of about 700 to 950 spm. When fired in fully automatic mode by experienced, right-handed shooters, controllability testing has shown that when firing from the standing position at 100 yards the second projectile of a burst strikes approximately one foot to the right and above the impact of the first projectile, and the third projectile strikes approximately two feet to the right and above the second projectile (three feet off-target). Furthermore it typically takes until about the seventh round before the shooter can force the shots back approximately onto the target, if at all. When the trigger is released, the rifle plunges down and to the left (down and to the right for a left-handed shooter). This makes target reacquisition time-consuming, difficult, and wasteful of ammunition.

Rifles having heavier recoil than the 5.56 mm NATO cartridge, such as those chambered for 7.62 mm NATO cartridge, greatly exacerbate the uncontrollability problem in full auto fire.

The high cyclic rate of fire problem with the M16 family of weapons has existed since the introduction of the M16 in the 1960's, and even though many solutions have been attempted, no simple and fully effective solution has been achieved.

The term "recoiling parts," as used herein, is applied to those parts of the firearm mechanism (such as the bolt, bolt carrier, etc.) that travel from battery to full recoil and then return to battery during the cycle of functioning. The term "recoiling parts" applies to these parts whether the parts are moving in recoil or in counter-recoil.

The U.S. military and private industry have developed several rate reducing mechanisms based on slowing the recoiling parts velocities of the M16/M4 family of weapons. While this slowing of recoiling parts results in somewhat reducing the cyclic rate, it also results in reducing weapon functional reliability. This reduction of reliability is because kinetic energy is removed from the system so this energy is therefore no longer available for reliably powering the mechanism under adverse operating conditions.

The largest disadvantage, however, accruing to slowing the recoiling parts in order to reduce cyclic rate is the inherent inability of such slowing to reduce the cyclic rate sufficiently to markedly increase hit probability within a given burst. Therefore, all such prior art rate reducers for the M16/M4 family of firearms not only fail to accomplish the goal of substantially improving controllability, but also reduce the vitally important characteristic of high reliability in a combat firearm.

In another example, U.S. Pat. No. 8,899,141 B2 describes a system that does not slow the recoiling parts, but greatly reduces the cyclic firing rate (to approximately 300 spm) through the use of an inertia weight which only delays actuating the automatic sear/firing, but undesirably requires major changes in the operating system components of the rifle.

Therefore, further improvements in this technological area are needed.

SUMMARY

Substantially improving hit probability by reducing the cyclic rate of an M16/M4 type system requires the temporary interruption of the firing mechanism itself, rather than slowing the recoiling parts.

The system of the present disclosure, hereinafter called the "rate reducer," solves a serious problem of the M16 that has been under investigation since the 1960's. The rate reducer is a small and simple device that improves controllability by delaying release of the hammer rather than slowing the recoiling parts.

The rate reducer is applicable to the M16/M4 family of weapons in particular, as well as being applicable to other weapons employing similar operating systems firing from the closed bolt position. The rate reducer is also applicable to weapons firing from the open bolt position.

The rate reducer herein described is a "drop-in" replacement for the automatic sear of the M16 family of weapons. Except for replacement of the original automatic sear, the rate reducer requires no modification of any parts of the firearm. Additionally, the original recoiling parts and firing mechanism parts are not affected in any way. The cyclic rate delivered by the preferred embodiment rate reducer is infinitely adjustable from theoretically essentially 0 spm to the full natural cyclic rate of the rifle. This cyclic rate adjustment is achieved through the use of a simple tool, such as an Allen wrench or a screwdriver so that any desired cyclic rate reduction can be set at the factory and then sealed into the unit. Alternatively, the adjusting screw can be left unsealed so the user, by experimentation, can determine the cyclic rate best suited to the expected tactical employment. In a further alternative, a pre-set, non-adjustable, orifice can be built into the rate reducer to deliver a pre-set cyclic rate reduction.

The rate reducer's mechanism is fundamentally different than that of rate reducing mechanisms that slow the velocity of recoiling parts. The rate reducer permits the recoiling parts to function unchanged and unaffected from their natural recoil/counter recoil velocities and functions. Since the recoiling parts of the firearm operate normally, the inherent reliability of the firearm is unaffected as compared to the original firearm; except, if anything, reliability is improved by providing more time for the ammunition stack in the magazine to be positioned and stabilized between rounds in a burst.

The reduction in cyclic rate is achieved by mechanically delaying the firing step in the cycle of functioning. This is achieved by temporarily delaying release of the hammer.

Setting the rifle for semiautomatic fire, or setting the rifle on "safe" remains unchanged, that is, does not change or interfere with the normal manner in which the safety blocks the trigger when set on "safe." When set for "semi" or on "safe" the rate reducer is completely disengaged from the hammer and all other firing mechanism or recoiling parts, consequently completely bypassing the rate reducer, and thereby permitting unaffected semi-automatic fire in the unlikely event of a rate reducer malfunction.

The rate reducer is fully compatible with the three round burst limiter of the M4 Carbine. When employed with the burst limiter, the rate reducer will substantially increase the hit probability of the second and third shots of bursts, as well as reduce barrel heating, conserve ammunition, and increase barrel life.

The rate reducer could be employed with open-bolt type firearms to temporarily halt/sear-up the bolt, rather than delay hammer fall during a burst.

In employment of the rate reducer, the fall of the hammer is delayed but not halted by the sear. Therefore, the timing of the trigger/sear engagement must be such that whenever the trigger is released the hammer will always sear up on the trigger immediately after firing the final round of the current burst. That is, the rate reducer sear and trigger function completely independently of each other and are timed such that when the hammer starts forward the trigger will always arrest the hammer after the hammer is released from the sear. This means there can never, as far as the rate reducer is concerned, be the unsafe condition of the hammer falling (having been released from the sear) after the trigger is released. The trigger must be pulled in order for the rifle to fire regardless of the position of the rate reducer sear. This safety characteristic prevents accidental firing, as far as the rate reducer is concerned.

Additionally, if the rate reducer were to jam, and in so doing, fail to release the hammer until a later time, then as long as the trigger was released (as would normally be the case with the rifle laid aside) when the rate reducer finally released the hammer, the hammer would safely drop into engagement with the trigger rather than to accidentally fire a shot.

Furthermore, if the rate reducer jammed and held the hammer cocked, and then if the selector were switched from "auto" to "semi" or "safe," the hammer would again drop safely into normal engagement with the trigger.

In another embodiment, the delay of release of the hammer is achieved through employment of an elastomer or other natural or synthetic viscoelastic polymer with weak intermolecular forces capable of relatively quickly recovering its original shape after being deformed; the rate of delay being controlled by the characteristics of the elastomer.

As an adjunct to any previous embodiment, a cam can be provided to augment movement of the sear away from the hammer hook in order to facilitate uniform release of the hammer and also to accommodate wear, design dimensional allowances, and manufacturing tolerance build-up.

Although hydraulic fluid is used in the following description, the use of a pneumatic gas or other suitable fluid is also anticipated and not precluded.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

FIG. 6 shows the hammer being cocked, and the hammer urging the sear rearward. The trigger remains pulled.

DETAILED DESCRIPTION OF THE ILLUSTRATIVE EMBODIMENTS

Figure 1:
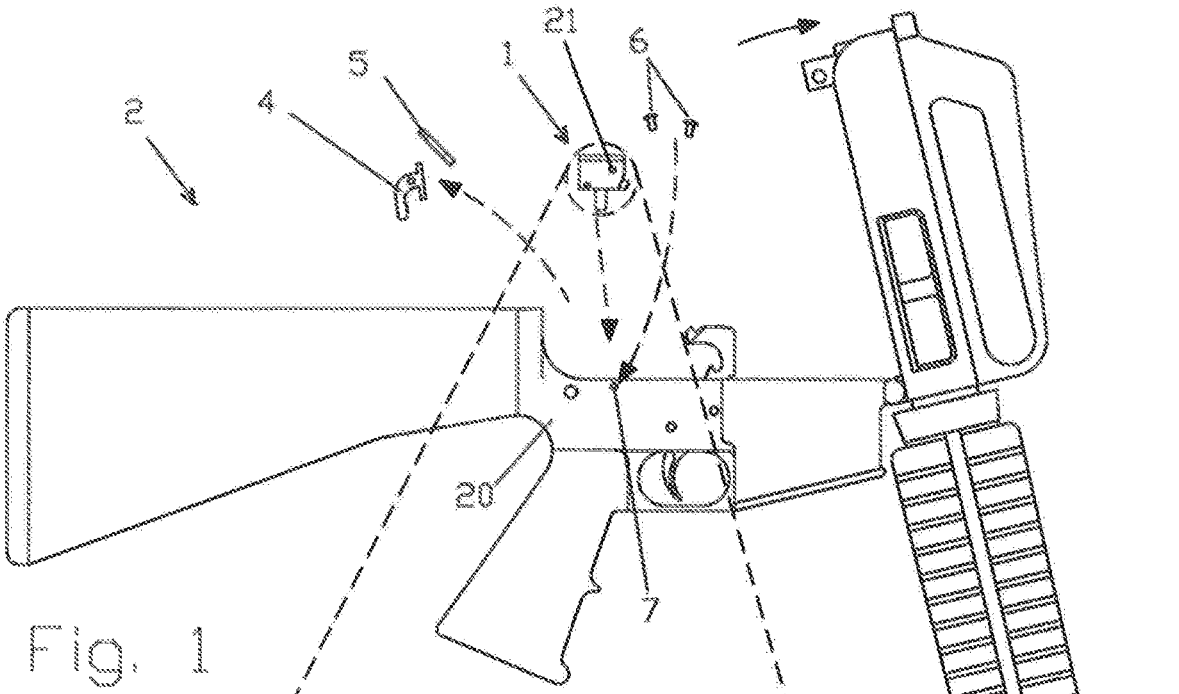
FIG. 1 is a right side view of an M16/M4 type firearm opened as it would be for field stripping. The rate reducer is shown poised before assembly into the rifle.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

All references to "forward" in the following description are toward the right of the sheet in all Figures. A small amount of friction is acknowledged, but is ignored for the purposes of this description. The standard issue disconnect, not being necessary for understanding this disclosure, is omitted in the Figures.

Referring now to FIG. 1 which shows an M16 type rifle 2 opened as it would be for field stripping. The prior art automatic sear pin 5 and the conventional/prior art automatic sear 4 have been removed. Rate reducer 1 is poised directly above lower receiver 20 of rifle 2. Rate reducer 1 will be moved into place in lower receiver 20, aligning threaded mounting holes 21 of rate reducer 1 with automatic sear pin holes 7 in lower receiver 20. Screws 6 will be inserted through automatic sear pin holes 7 in lower receiver 20, and screwed into mounting holes 21 of rate reducer 1. This completes installation of the rate reducer. The rifle may now be closed, loaded and fired as usual. While screws are used herein for describing installation of rate reducer 1 in lower receiver 20, other means of attachment such as studs, pins, rivets, fasteners, etc. are contemplated.

Figure 2:
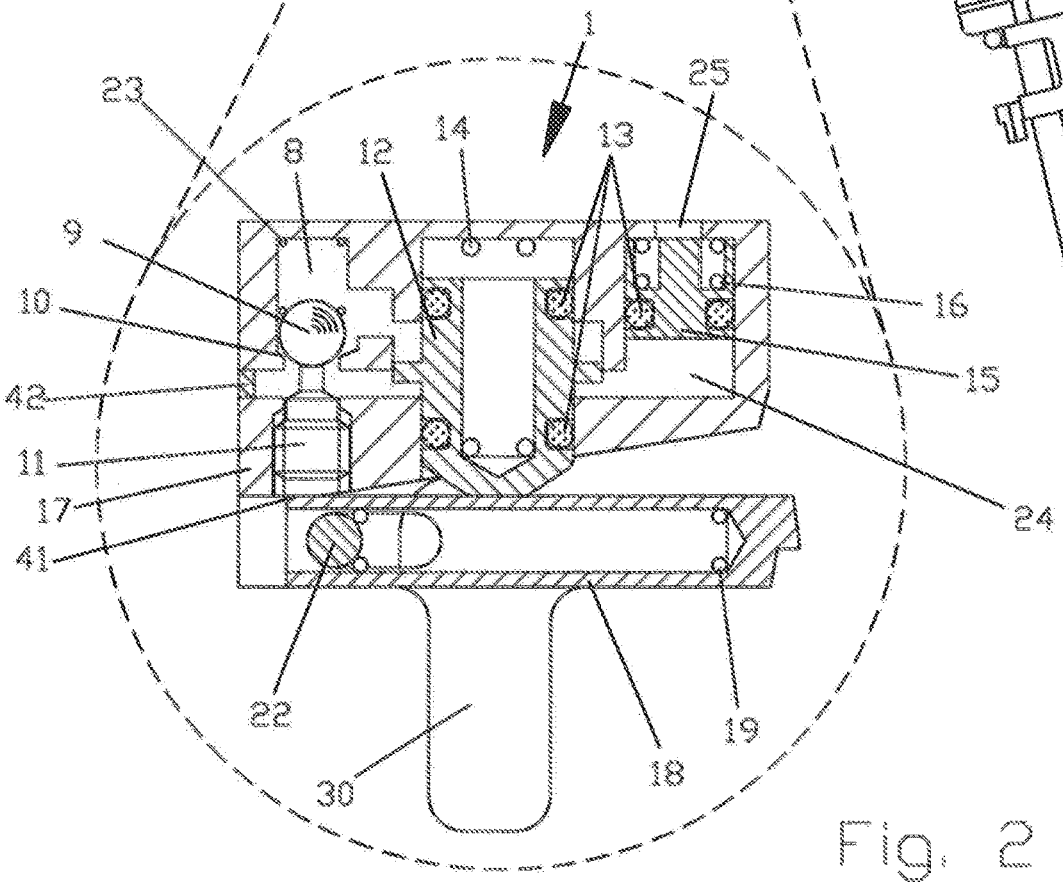
FIG. 2 is an enlarged and sectioned view of the rate reducer.

Referring now to FIG. 2 which is an enlarged and sectioned view of the rate reducer 1 as shown in FIG. 1. Sear 18 is rotatably and slideably mounted on pivot 22. Pivot 22 is inserted into rate reducer body 17. Plug 42, which retains fluid 8, is not necessary for understanding the present disclosure but shows where fluid 8 could be injected into the rate reducer.

Sear spring 19, buttressed against pivot 22, urges sear 18 forward. Sear 18 is limited in its forward movement by pivot 22. Piston 12, via spring force applied by piston spring 14, is urging the front of sear 18 downward. Sear 18 is therefore being urged downward and forward. The downward rotational movement of sear 18 is limited by contact with rate reducer body 17 at contact area 41, at the rear of sear 18.

Valve 9, herein shown as a steel ball bearing, is adjustably held out of contact with valve seat 10 by valve adjusting screw 11. The gap between valve 9 and valve seat 10 regulates the flow of fluid 8. Controlling the rate of flow of fluid 8 regulates the speed at which piston 12 moves upward, which thereby regulates the speed at which the front of sear 18 moves upward, which in turn controllably delays the release of the hammer (not shown) which ultimately dictates the cyclic rate of the rifle. Other types/shapes of valves, such as "V" shaped valves, reed valves, ball or gate valves, poppet valves, etc. are contemplated. Valve 9 is being held in place on top of valve adjusting screw 11 by valve spring 23. Adjusting screw 11 may be affixed in rate reducer body 17 by welding, etc. at the factory to prevent tampering; or valve adjusting screw 11 may be installed and sealed using a high viscosity sealant to prevent leaking, but that will permit adjustment of the cyclic rate by the user.

Fluid 8, a suitable hydraulic fluid, fills the internal functional volume of rate reducer 1 including fluid reservoir 24. Fluid reservoir 24 provides a fluid reserve to replace life-cycle loss through minor leakage past (the three) O-rings 13. Plunger 15, in reservoir 24, is urged downward by plunger spring 16, so the rate reducer permanently remains somewhat pressurized, thereby preventing voids in fluid 8. Optional inspection hole 25 can be provided in rate reducer body 17 to facilitate checking the position of plunger 15 in order to determine the amount of fluid remaining in the system. A low reading would indicate the need to refill or replace the rate reducer before it ran out of fluid.

Figure 3C:
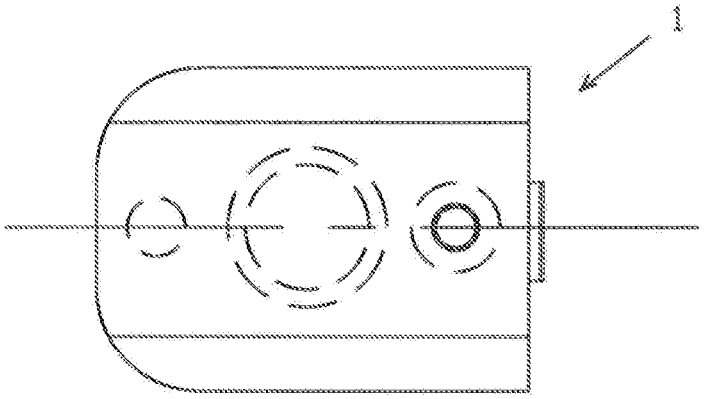
FIGS. 3A, 3B, and 3C are right side, front and top views of the rate reducer.
Figure 3A:
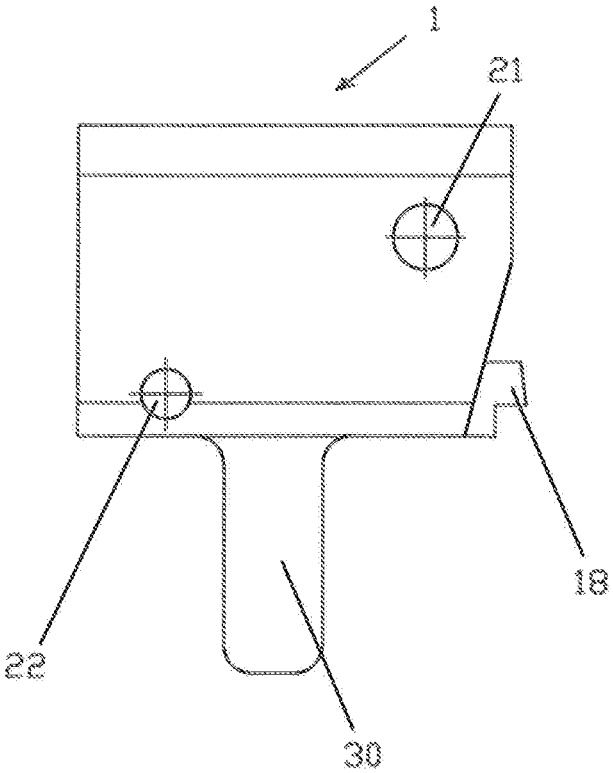
Figure 3B:
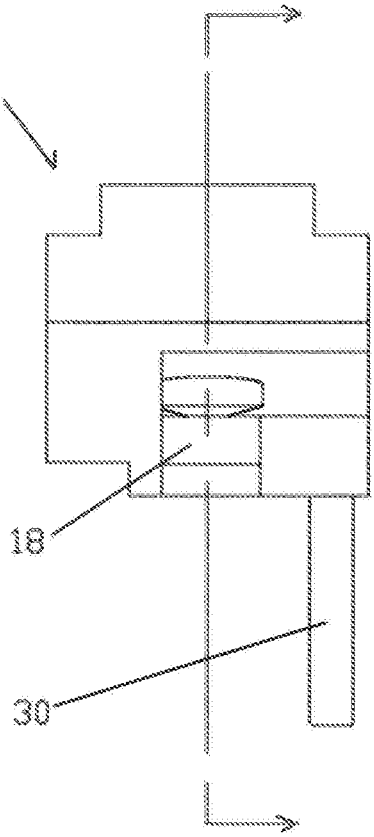

Referring to FIGS. 3A, 3B and 3C which are side, front and top views respectively of rate reducer 1. The rate reducer fits within the unmodified space provided in the lower receiver of the rifle after removal of the prior art issue automatic sear 4 and automatic sear pin 5 shown in FIG. 1. Notice in FIG. 3B that sear projection 30 is located to align with the automatic sear notch 29 in selector 34 as shown in FIGS. 4 through 17.

Figure 4:
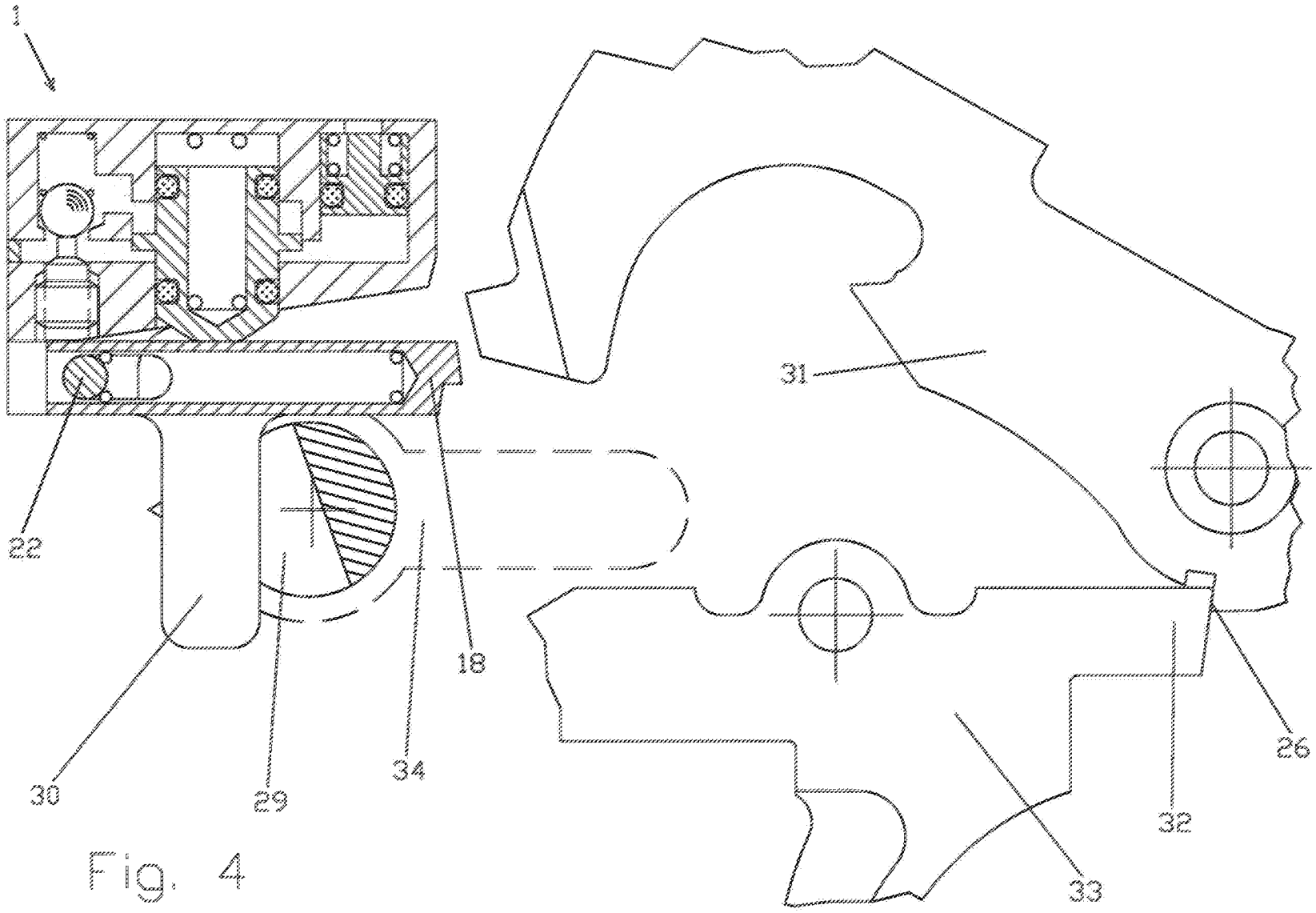
FIG. 4 is a right side section view with the hammer cocked and the rate reducer in the ready position. The selector is set to "auto."

Referring now to FIG. 4 in which rate reducer 1 is shown sectioned on the centerline-line shown in FIG. 3B. Hammer 31 is cocked, being retained by trigger nose 32 of trigger 33 at trigger/hammer contact 26. Selector 34 is set on "auto." This illustrates the ready condition of the firing mechanism before the first round of a burst. Rate reducer sear 18 is not involved at this point.

Automatic sear notch 29 of selector 34 is located just inside the left-hand wall of the rifle lower receiver (not shown). Sear projection 30 of sear 18 has a clearance fit within the unmodified automatic sear notch 29 of selector 34. See FIG. 3B for the front view of rate reducer 1 showing the location of sear projection 30.

Figure 5:
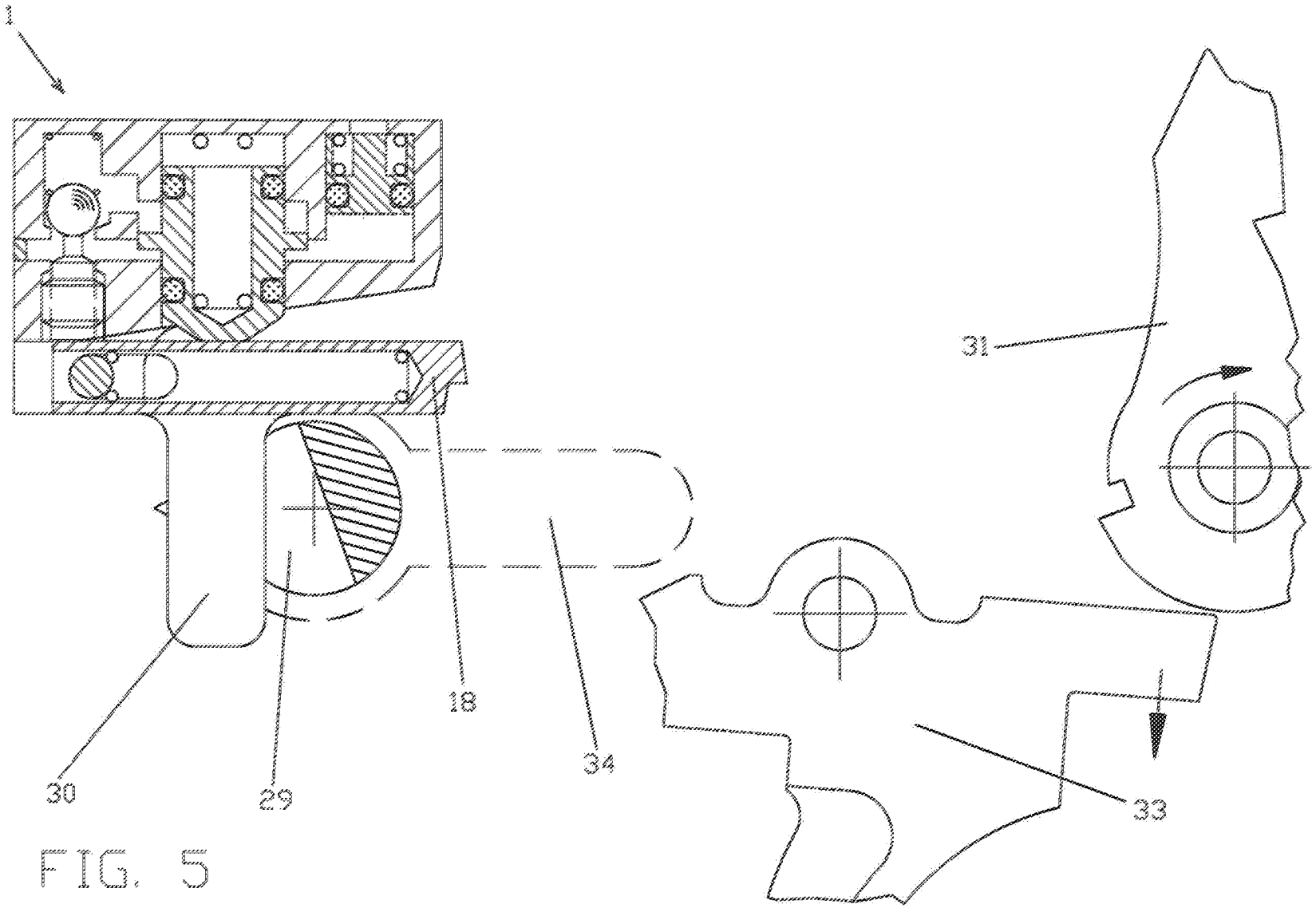
FIG. 5 is like FIG. 4, except the trigger has been pulled and the hammer is forward.
Figure 5:
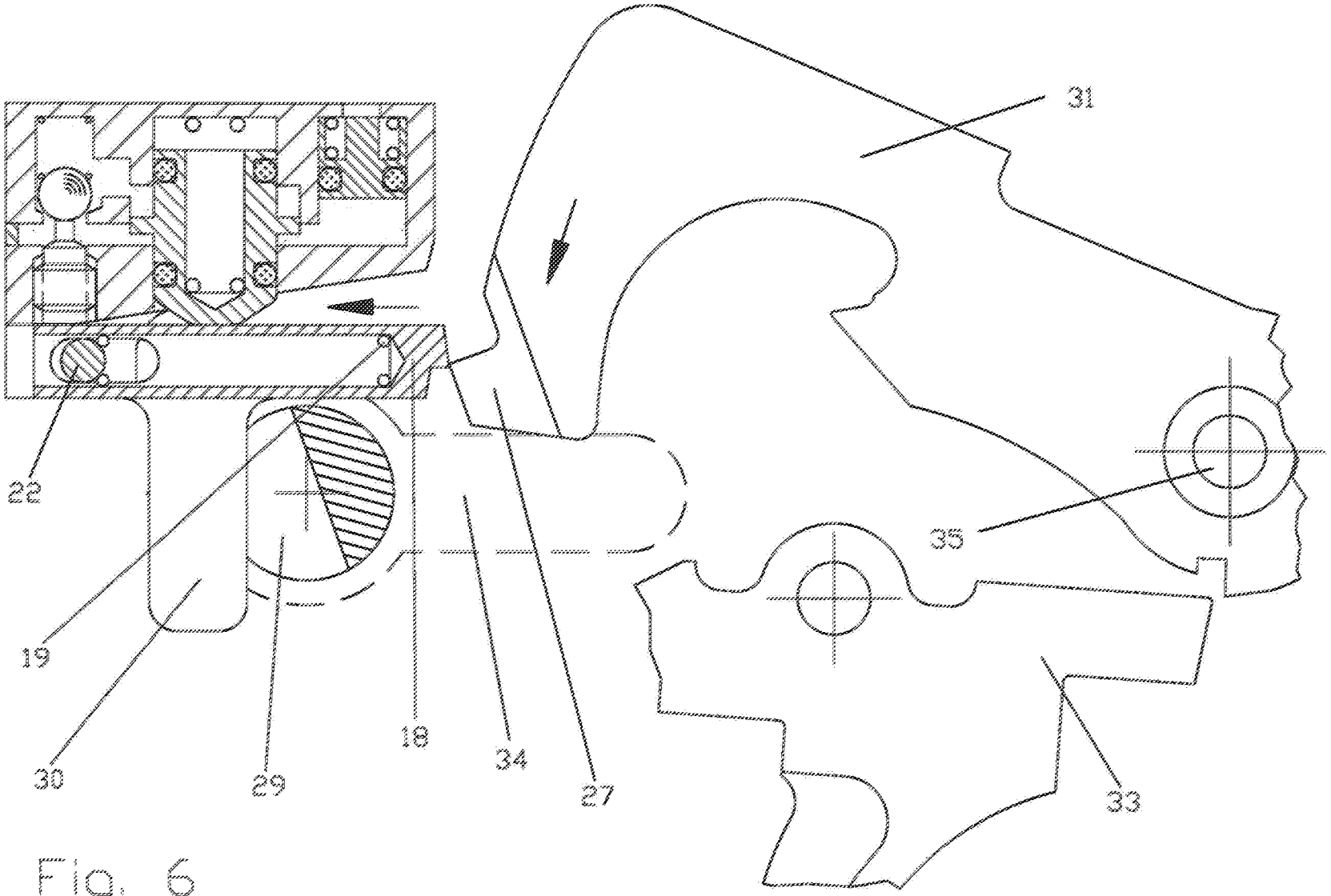

Referring to FIG. 5 which is like FIG. 4, but trigger 33 has been pulled, releasing hammer 31 to fire the rifle. No activity has yet occurred within rate reducer 1. FIGS. 4 and 5 represent the firing of the first round of a burst where there is no delay in firing of the first round. This is important because it is imperative there be no delay between actuation of the trigger and firing the first round.

Referring to FIG. 6 in which the bolt carrier (not shown) as a recoiling part, is rotating hammer 31 rearward about hammer pin 35. Hammer hook 27 has made contact with the front of sear 18, and hammer hook 27 is urging sear 18 rearward, compressing sear spring 19 against pivot 22, as would occur during re-cocking for any round during a burst.

Figure 7:
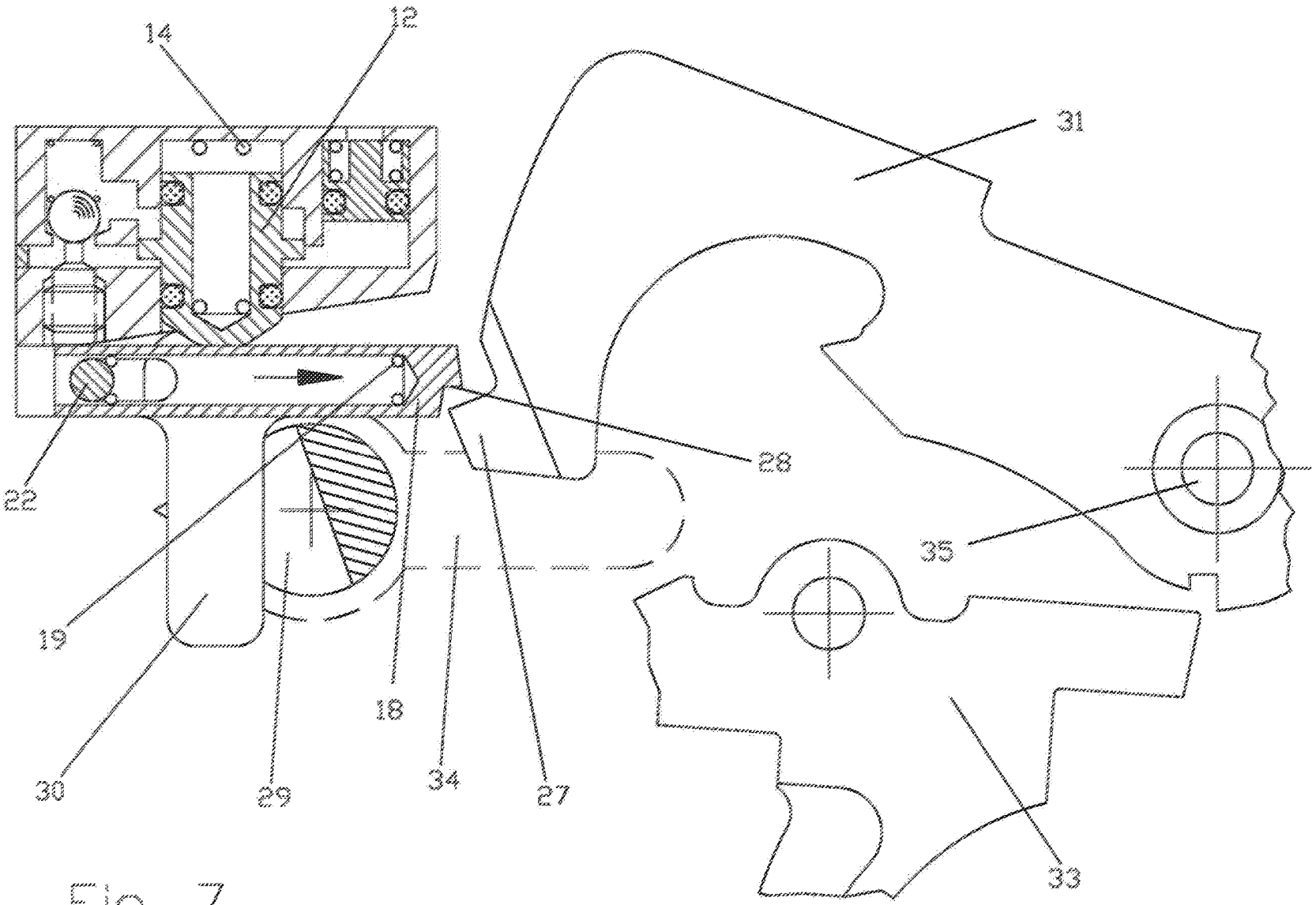
FIG. 7 shows the hammer fully rearward with the sear repositioned fully forward. The trigger remains pulled.

Referring to FIG. 7 in which the bolt carrier (not shown) is in full recoil, and consequently holding hammer 31 rotated fully rearward. Hammer hook 27 is positioned well below the level of sear surface 28 of sear 18, permitting sear spring 19 to freely return sear 18 to its forward position so that when hammer 31 rotates forward again, hammer hook 27 will engage sear surface 28 of sear 18. Piston spring 14 is urging piston 12 downwardly against the top of sear 18 as sear 18 slides forward into the path of hammer hook 27. Trigger 33 remains pulled during a fully automatic burst.

Figure 8:
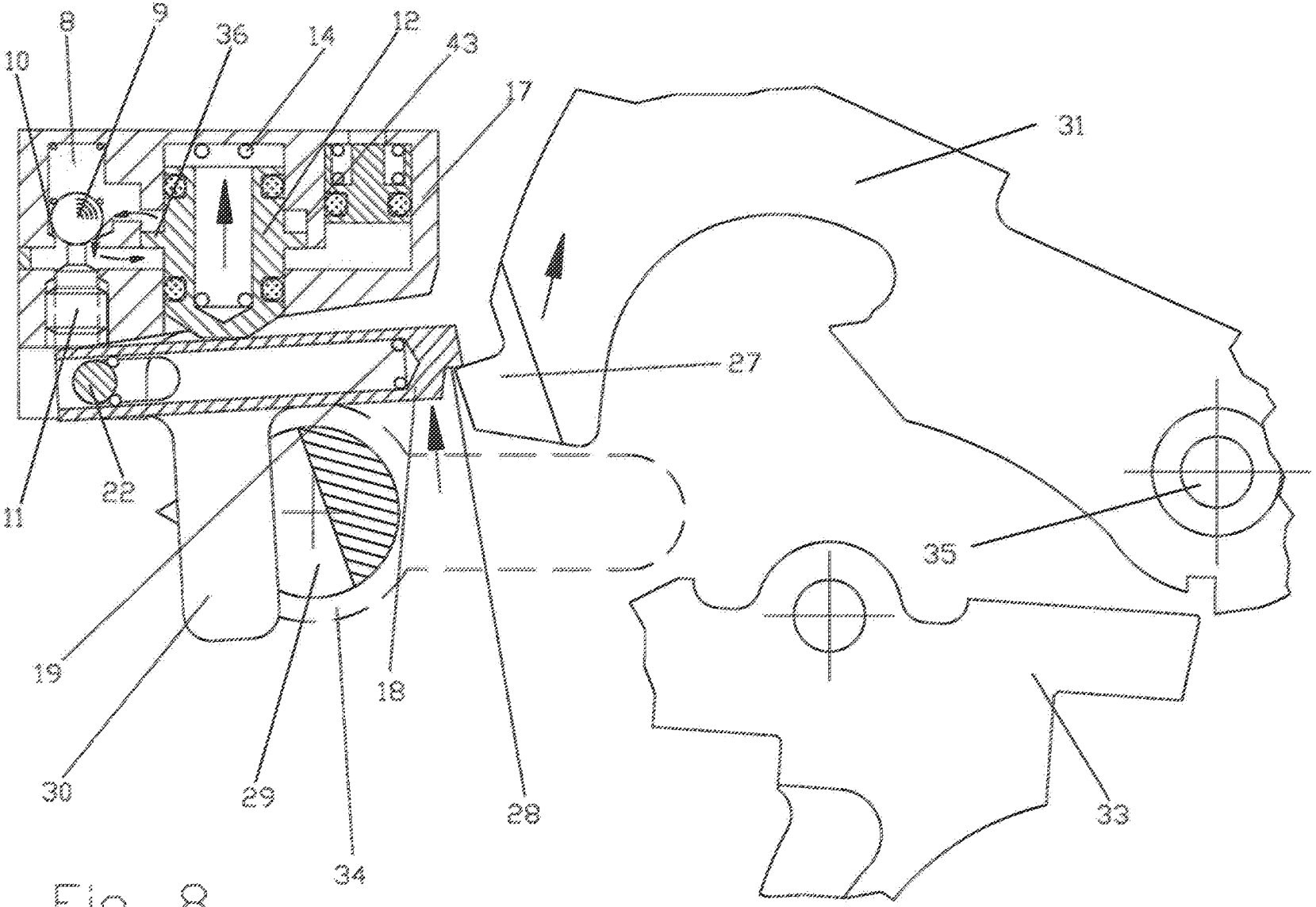
FIG. 8 shows the hammer beginning to rotate forward, but being retarded by the sear. The trigger remains pulled.

Referring to FIG. 8 in which the bolt carrier (not shown) has returned to battery. Trigger 33 is still pulled, which will permit hammer 31 to continue to rotate upward and forward about hammer pin 35 to fire the next shot. Hammer hook 27 of hammer 31 has engaged sear surface 28 of sear 18. Piston spring 14 applies resistance against upward movement of piston 12 and sear 18, but since the hammer spring (not shown) is substantially stronger than piston spring 14, piston spring 14 does not significantly impede upward movement of piston 12 and sear 18.

However, as piston 12 moves upward, piston flange 36 of piston 12 displaces fluid 8 within cylinder bore 43 of rate reducer body 17. Piston flange 36 has a close sliding fit with cylinder bore 43 in rate reducer body 17 so that very little of fluid 8 can escape downward past piston flange 36. Therefore, the only available bleed-down pathway for fluid 8 to circulate back under piston flange 36 is to pass between valve 9 and valve seat 10, as shown by the arrows in fluid 8.

Valve 9 is resting against the top of valve adjusting screw 11. Valve adjusting screw 11 is threadedly engaged with rate reducer body 17 such that screwing valve adjusting screw 11 in/up will increase the clearance between valve 9 and valve seat 10. Conversely, screwing valve adjusting screw 11 out/down will decrease the clearance between valve 9 and valve seat 10. Setting valve adjusting screw 11 so there is a small gap between valve 9 and valve seat 10 will result in a restriction in the flow of fluid 8 when sear 18 and piston 12 are being lifted by hammer 31 through the force of the hammer spring (not shown). Restricting the flow of fluid 8 substantially delays initial rotation of hammer 31 toward firing. The smaller the clearance between valve 9 and valve seat 10, the slower the flow of fluid 8 between valve 9 and valve seat 10. The slower the flow of fluid 8, the longer the delay of release of hammer 31 and therefore the slower the cyclic firing rate.

Valve adjusting screw 11 can be screwed out/down far enough to entirely eliminate the clearance between valve 9 and valve seat 10, effectively stopping flow of fluid 8, essentially resulting in a cyclic rate of zero spm. Valve adjusting screw 11 can also be screwed in/up far enough, increasing the clearance between valve 9 and valve seat 10, so fluid 8 can flow freely, resulting in approximately the normal, unreduced cyclic rate.

Figure 9:
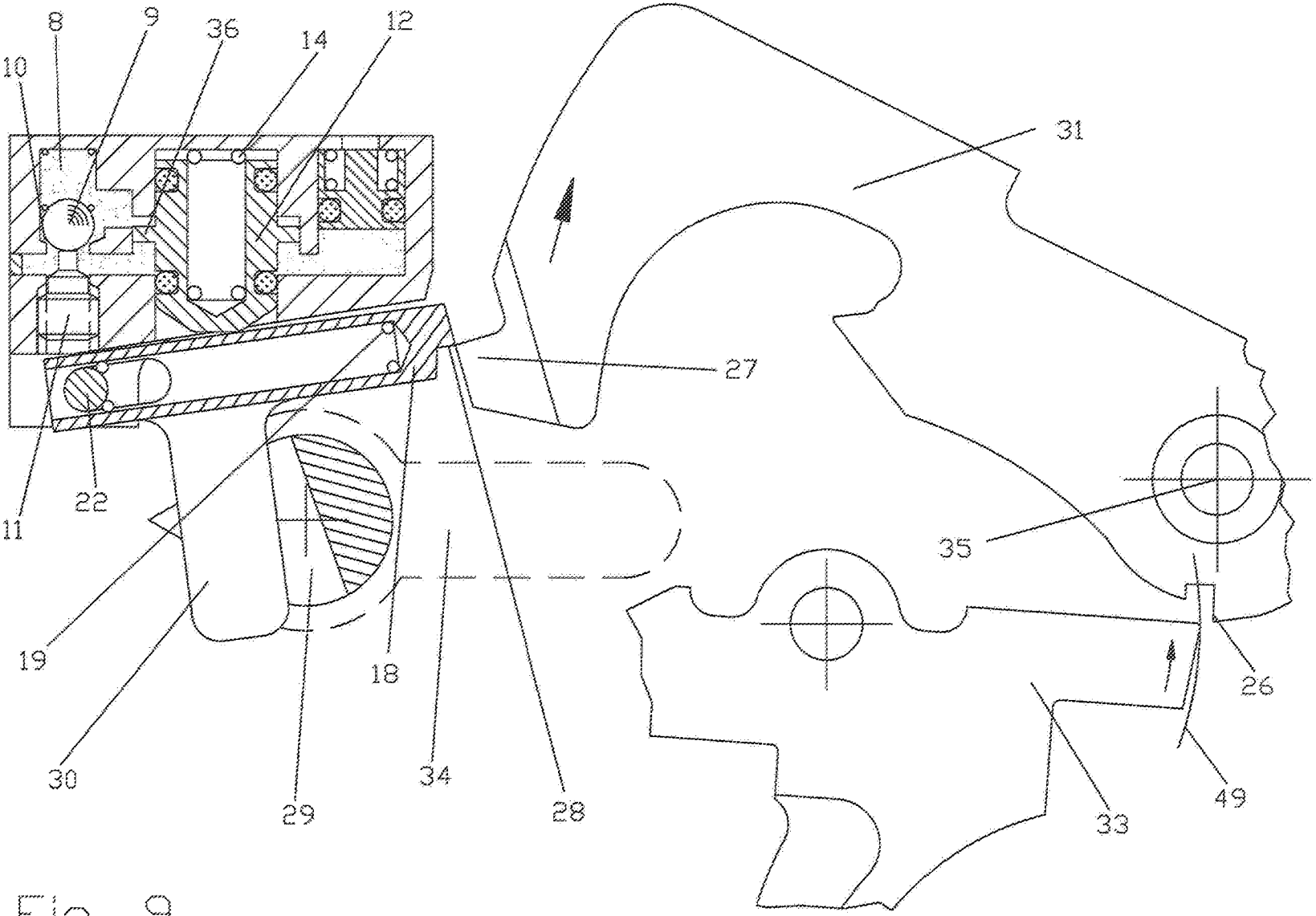
FIG. 9 shows the hammer at the moment of release by the sear. The trigger remains pulled.

Referring now to FIG. 9 which is like FIG. 8 except that hammer 31 and sear 18 have rotated up slightly farther. Hammer hook 27 of hammer 31 is, at this instant, slipping off sear surface 28 of sear 18, releasing hammer 31 to rotate unrestrictedly forward, being urged by the hammer spring (not shown). Fluid 8 has stopped moving at this instant. Sear 18 and piston 12 having reached their uppermost positions, have compressed piston spring 14.

Note that in this position, sear projection 30 freely clears selector 34 within automatic sear notch 29. Therefore, at this time, sear projection 30 has no contact with any portion of automatic sear notch 29 of unmodified selector 34. Sear 18, having disengaged from hammer hook 27, is now free to be returned by piston 12 and piston spring 14 to its position as shown in FIG. 4.

Notice also that if trigger 33 were released at any point up to and including that shown in FIG. 9, hammer 31 would be safely arrested by trigger 33, as indicated by the arc 49 shown relative to potential trigger/hammer contact 26, rather than allowing hammer 31 to continue forward and accidentally fire the rifle after the trigger was released. The timing of these interactions provides a fail-safe safety feature of the rate reducer 1.

Figure 10:
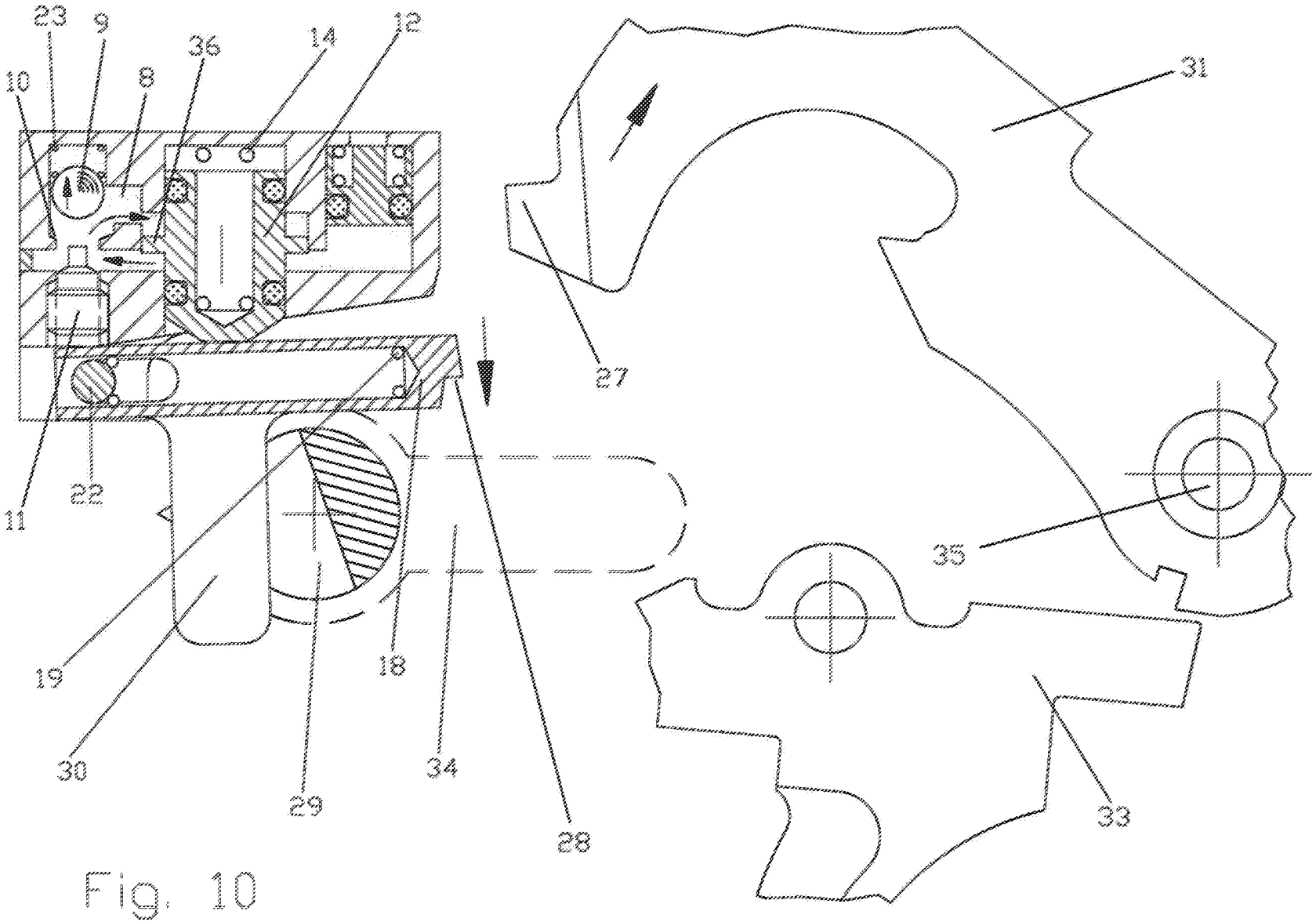
FIG. 10 shows the hammer continuing forward toward firing, and the sear returning toward its original/ready position. The trigger remains pulled.

Referring now to FIG. 10, trigger 33 is still pulled and hammer 31 is still rotating forward about hammer pin 35. Sear 18 has been released by hammer hook 27 so sear 18 can be urged downward by piston spring 14 acting through piston 12. At this time fluid 8 is flowing in the opposite direction than in the previous Figures. Now hydraulic pressure is being applied to the bottom of valve 9 by the upward flow of fluid 8. The upward force of fluid 8 on valve 9 presses upwardly against valve spring 23. Valve spring 23 applies much less downward resistance force to valve 9 than piston spring 14 applies downwardly on piston 12, so valve 9 is easily lifted away from valve seat 10, compressing valve spring 23 and permitting fluid 8 to circulate freely from below flange 36, of piston 12 to above flange 36. This means that piston 12 can quickly return sear 18 to its position shown in FIG. 4, ready to controllably delay firing of the next round. The above described process repeats from FIG. 5 through FIG. 10 during a burst until the release of trigger 33.

Figure 11:
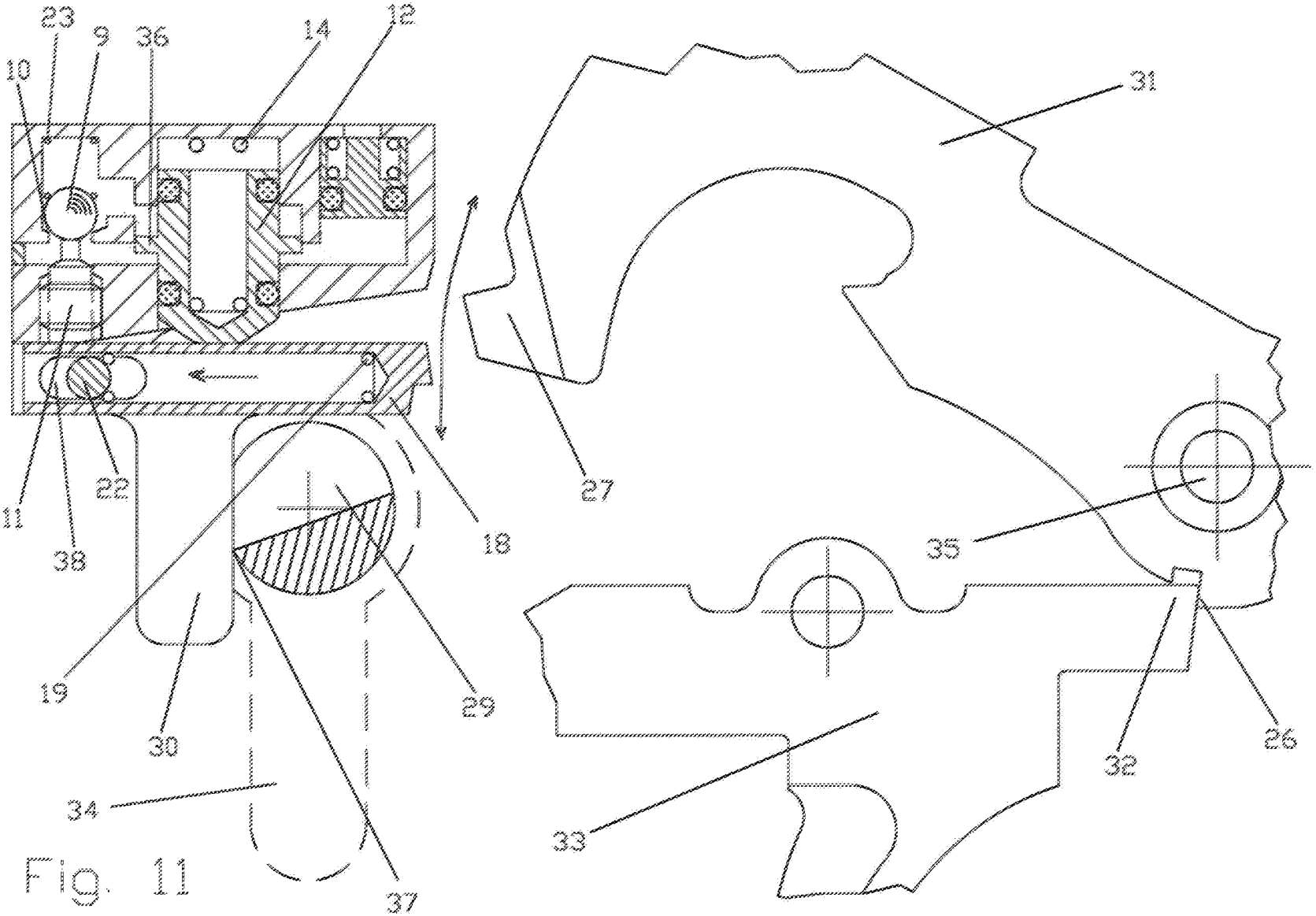
FIG. 11 illustrates the rate reducer with the selector set for semi-auto.

Referring now to FIG. 11 in which trigger 33 is in the released position. Hammer 31 has been arrested in the cocked position with hammer 31 resting on trigger nose 32 of trigger 33 at trigger/hammer contact 26. Selector 34 has been rotated 90° clockwise from "auto" to "semi." In previous figures the inside surfaces of automatic sear notch 29, in selector 34, had no contact with sear projection 30, but in this figure selector 34 has forced sear projection 30 rearward at selector/sear projection interface 37. Sear 18 can reciprocate on pivot 22, within slot 38, so that sear 18 is moved rearward out of the path of hammer hook 27, as shown by the arrows relative to hammer 31. In this condition hammer hook 27 cannot contact sear 18 during semiautomatic fire. Thus, in semiautomatic fire the rifle only utilizes the unmodified prior art components of the firing mechanism. Therefore, in the unlikely event of a failure of the rate reducer, the reliability of the rifle in semi-automatic fire would not be disturbed because there is no way in which sear 18, which is now totally isolated from the firing mechanism, could delay or interfere with firing.

Figure 12:
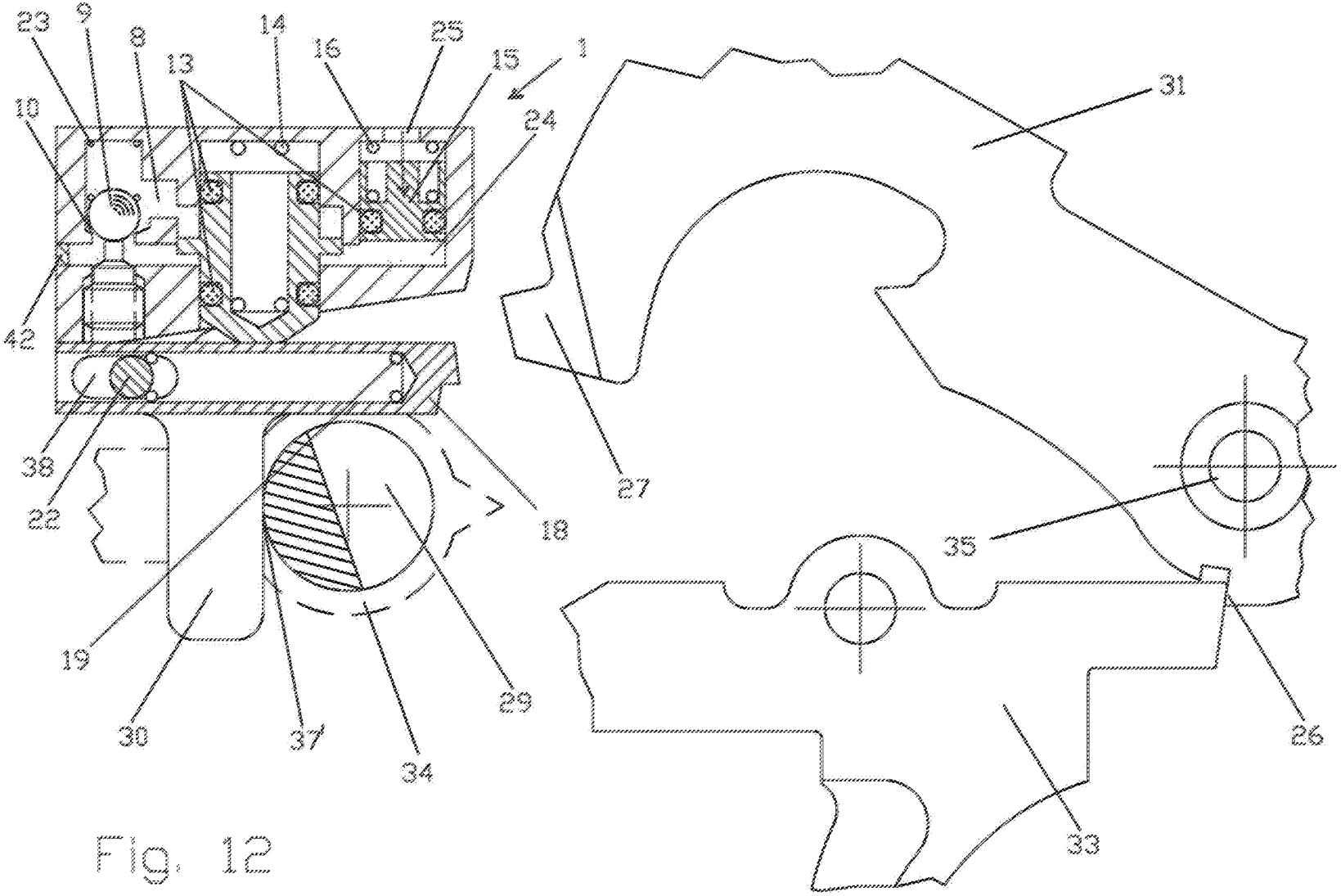
FIG. 12 illustrates the rate reducer with the selector set on "safe."

Referring now to FIG. 12 which is like FIG. 11, except selector 34 has been rotated a further 90° clockwise from "semi" to "safe." Sear projection 30 of sear 18 is in contact with selector 34 at selector/sear projection interface 37'. Selector 34 has forced sear projection 30 and sear 18 slightly farther rearward than as shown in FIG. 11. This additional movement of sear 18 is not necessary for safety function but is coincidental to further rotation of selector 34. Slot 38 in the rear of sear 18 is designed to accommodate this further rearward movement of sear 18.

The rate reducer is provided with reservoir 24. Reservoir 24 is not necessary for functioning, but is for replenishing any fluid that might be lost through slow leakage past 0-ring(s) 13 during the life of the rate reducer. Plunger spring 16 urging plunger 15 downward, continuously applies a small amount of pressure to fluid 8, thus keeping the functional internal volume of rate reducer 1 full of fluid, and prevents voids in the fluid.

The rate reducer does not need an accumulator because the fluid internal volume remains constant during functioning. Plug 42 is inserted and sealed after rate reducer 1 has been filled with fluid 8. There are numerous options contemplated in lieu of plug 42 for sealing rate reducer 1.

Figure 13:
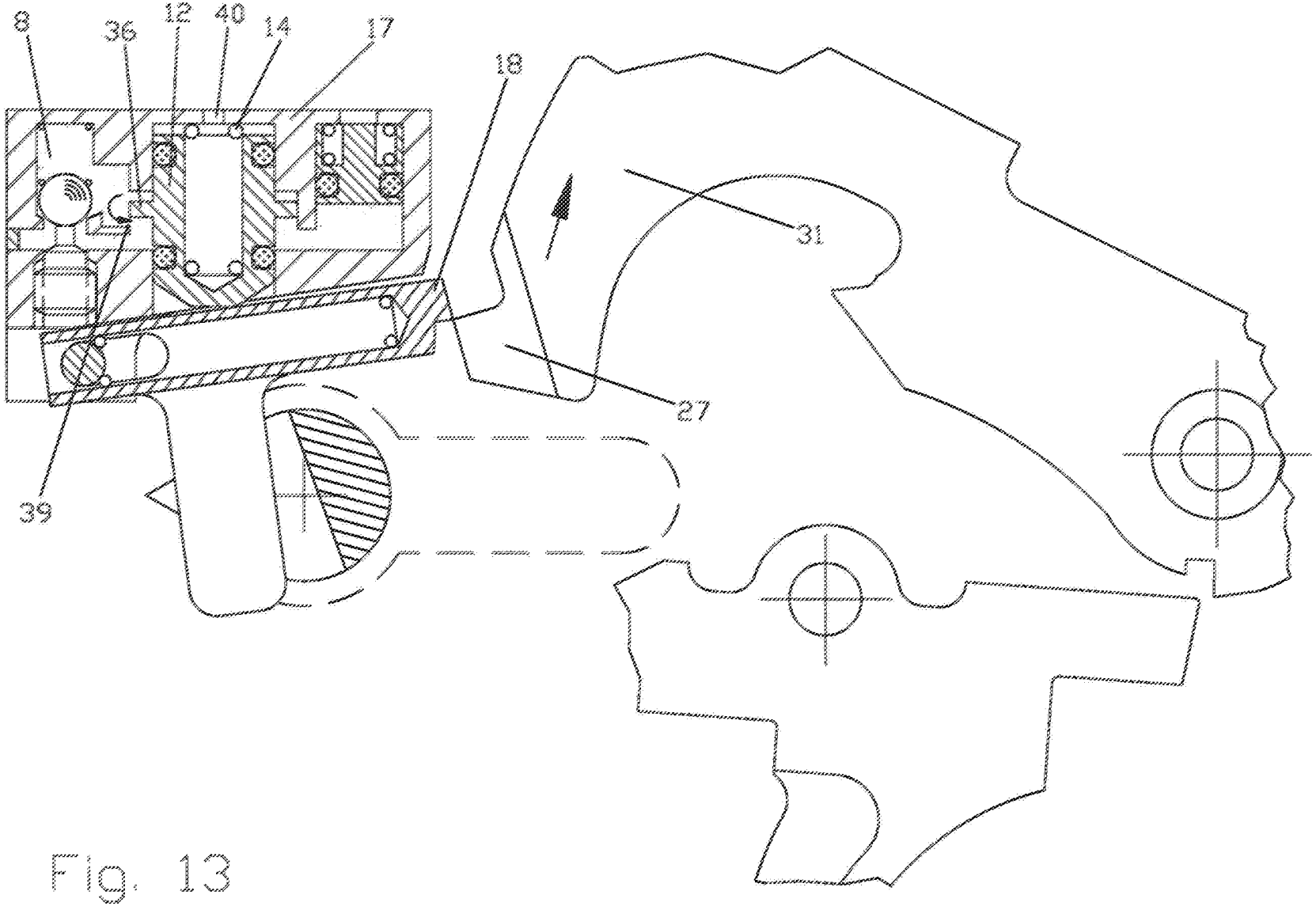
FIG. 13 illustrates an optional design incorporating an "early release" feature.

Referring now to FIG. 13 which illustrates an alternative design having a bypass cut 39 provided in rate reducer body 17 so that just as piston flange 36 passes bypass cut 39, fluid 8 can quickly escape and therefore quickly circulate back under piston flange 36, quickly releasing resistance to sear 18, thereby releasing hammer hook 27 of hammer 31 at a predetermined location rather than when hammer hook 27 happens to slip off sear 18. This will mitigate variations in the cyclic rate due to inconsistencies in the rifle components.

In FIG. 13 rate reducer body 17 is provided with an optional port 40 above piston 12 to permit entry and exit of air during cycling of piston 12 for situations where port 40 might be found desirable in the design. If in situations where port 40 is not required, the air trapped above piston 12 will serve as a gas spring to augment piston spring 14.

Figure 14:
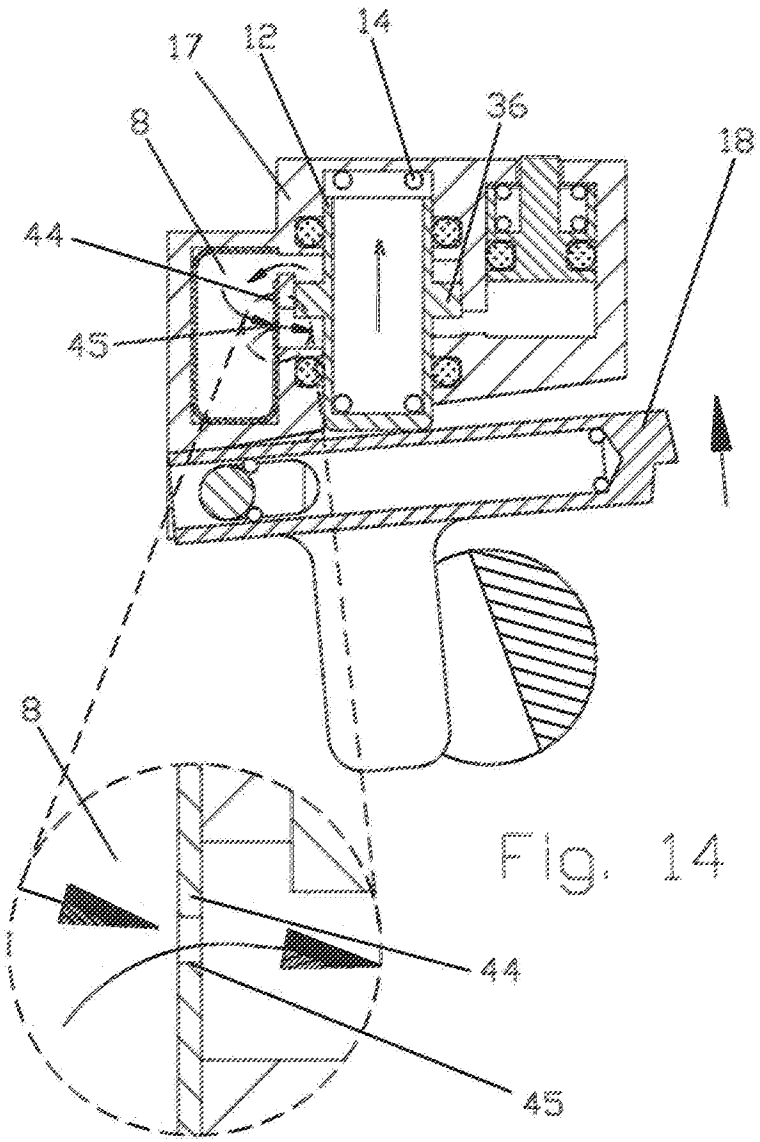
FIG. 14 illustrates a rate reducer employing a reed-valve delaying release of the hammer.

Referring now to FIG. 14 which is a second embodiment in which a reed valve 44 is provided with a metering hole 45. Sear 18 is being urged upwardly by the hammer, (not shown). Sear 18 is urging piston 12 upwardly, compressing piston spring 14. Piston flange 36 of upwardly moving piston 12 is pressurizing fluid 8, causing fluid 8 to flow through metering hole 45 in reed valve 44. Fluid 8 is therefore circulating from above piston flange 36 of piston 12, through metering hole 45 of reed valve 44, to below piston flange 36 as piston 12 is forced upward by sear 18. The rate of upward motion of piston 12 and sear 18 is governed by the cross-sectional area, or hole size, of metering hole 45. Therefore, the cyclic rate of the firearm is governed by the size of metering hole 45.

Figure 15:
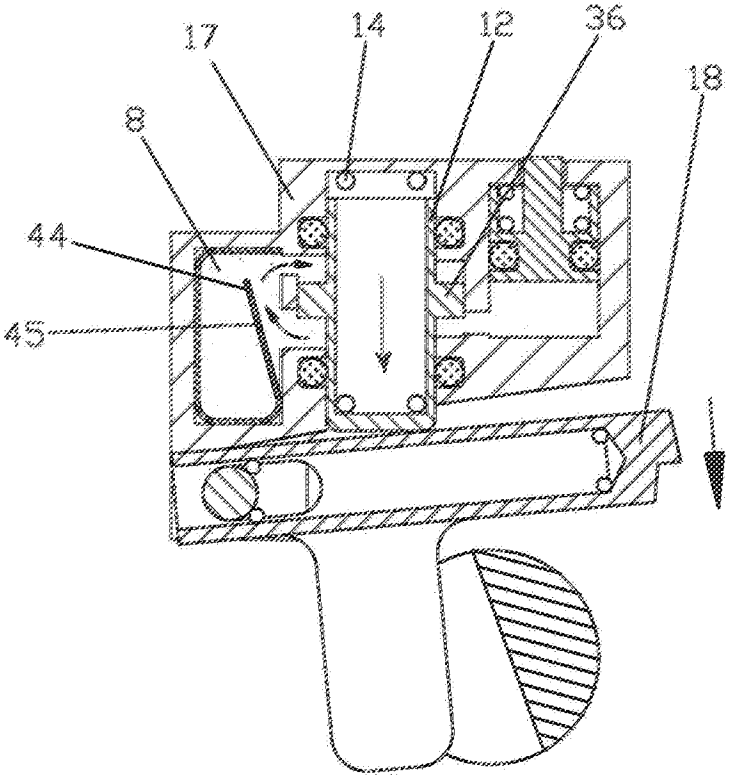
FIG. 15 illustrates the rate reducer of FIG. 14 recovering toward its original position.

Note that in FIGS. 14 and 15 the O-rings that seal piston 12 with rate reducer body 17, are located in rate reducer body 17, rather than in piston 12 as shown in FIGS. 4 through 13. Placement of seals is a matter of practical design rather than operating principle, and either arrangement is contemplated.

Referring now to FIG. 15 which is like FIG. 14 except the hammer (not shown) has been released by sear 18, and piston spring 14 is forcing piston 12 downward. The downward force applied by piston spring 14 to piston 12, and consequently to fluid 8, substantially exceeds the resistance applied by reed valve 44, thereby forcing reed valve 44 open and permitting fluid 8 to circulate rapidly from below piston flange 36 to above piston flange 36. Piston spring 14 thus urges piston 12 downward, returning sear 18 to its original position.

Figure 16:
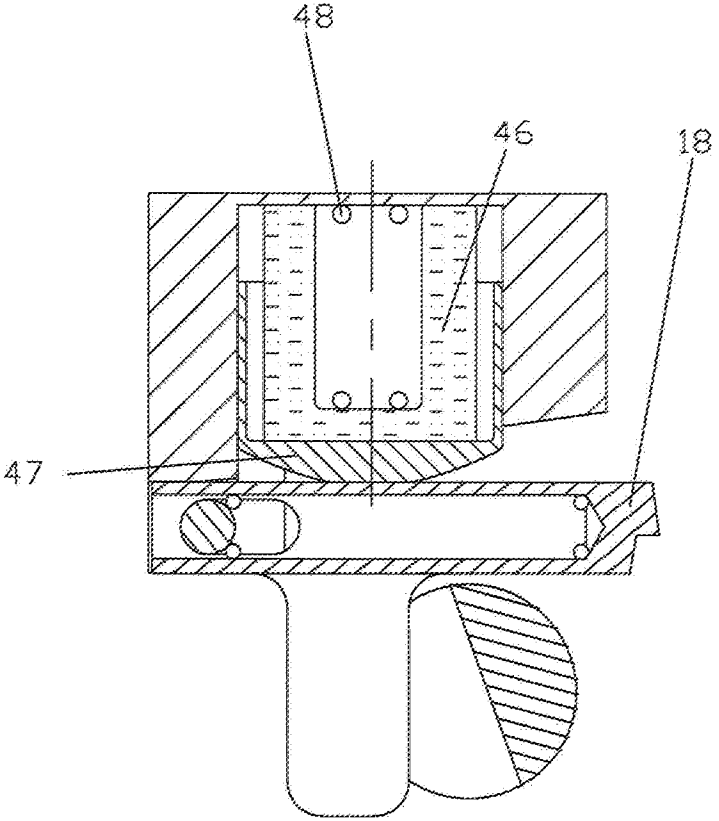
FIG. 16 illustrates a rate reducer employing and elastomer ready to delay the hammer (not shown).

Referring now to FIG. 16 which illustrates another embodiment of a rate reducer based upon delaying release of the hammer through employment of an elastomer or other natural or synthetic viscoelastic polymer with weak intermolecular forces capable of relatively quickly recovering their original shape after being deformed. Note that O-rings are not employed in this embodiment.

Elastomer 46, in this case, is a cylinder with a solid bottom housing elastomer cup spring 48 which is urging elastomer 46 and cup 47 downward against sear 18. Elastomer 46 is in its relaxed condition.

Figure 17:
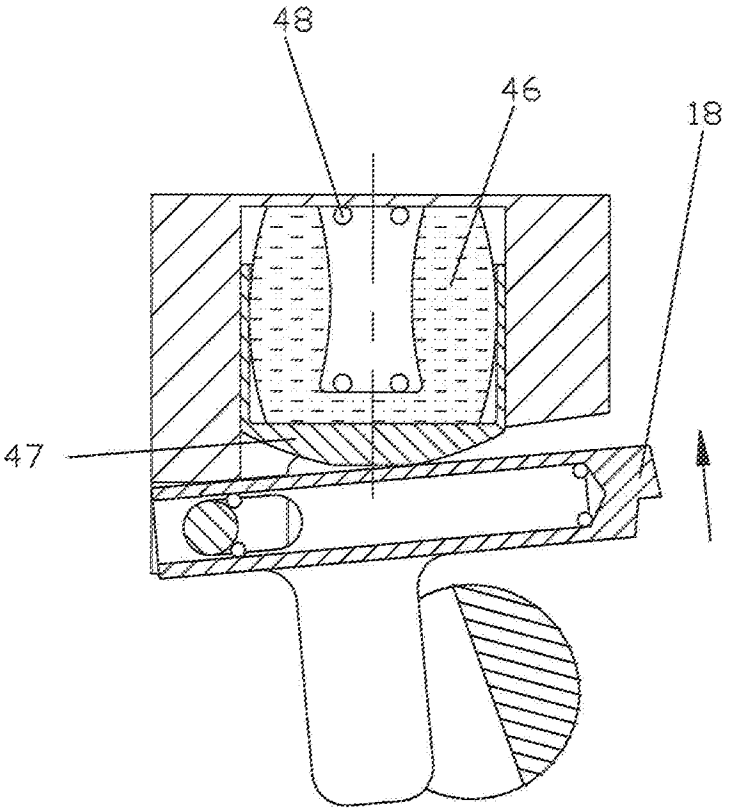
FIG. 17 illustrates the rate reducer of FIG. 16 delaying release of the hammer (not shown) using an elastomer.

Referring now to FIG. 17 in which the hammer (not shown) is forcing sear 18 upward, which in turn, is forcing cup 47 upward, deforming elastomer 46 and compressing elastomer cup spring 48. The length of delay of release of the hammer (not shown) is governed by the amount of time required to sufficiently deform elastomer 46 to permit release of the hammer.

Once the hammer has been released, elastomer cup spring 48 can return sear 18, elastomer 46, and cup 47 to their position shown in FIG. 16. The cyclic rate reduction is governed by the viscoelastic characteristics of elastomer 46. Elastomer cup spring 48 may not be necessary depending upon the elastomeric characteristics of elastomer 46.

Figure 18:
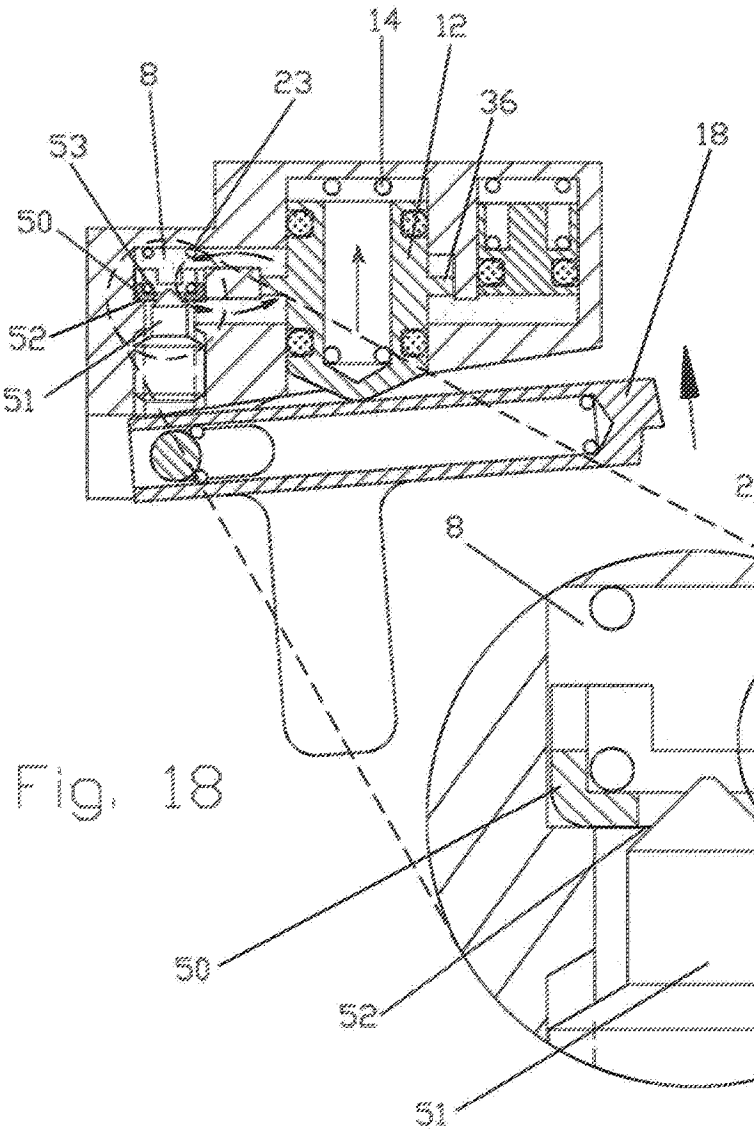
FIG. 18 illustrates an embodiment employing a needle valve and a poppet during delay of hammer release.

Referring now to FIG. 18 which is an embodiment that is similar to that shown in FIGS. 4 through 13, except this embodiment employs a poppet 50 and a needle valve 51 to regulate flow of fluid 8. The hammer (not shown) is forcing sear 18 and piston 12 upward, and compressing piston spring 14. Piston flange 36 is forcing fluid 8 through orifice 53 in poppet 50 past needle valve 51, regulating the rate at which sear 18 moves upward, and thus, as in FIGS. 4 through 13, controls the cyclic rate of the firearm.

Figure 19:
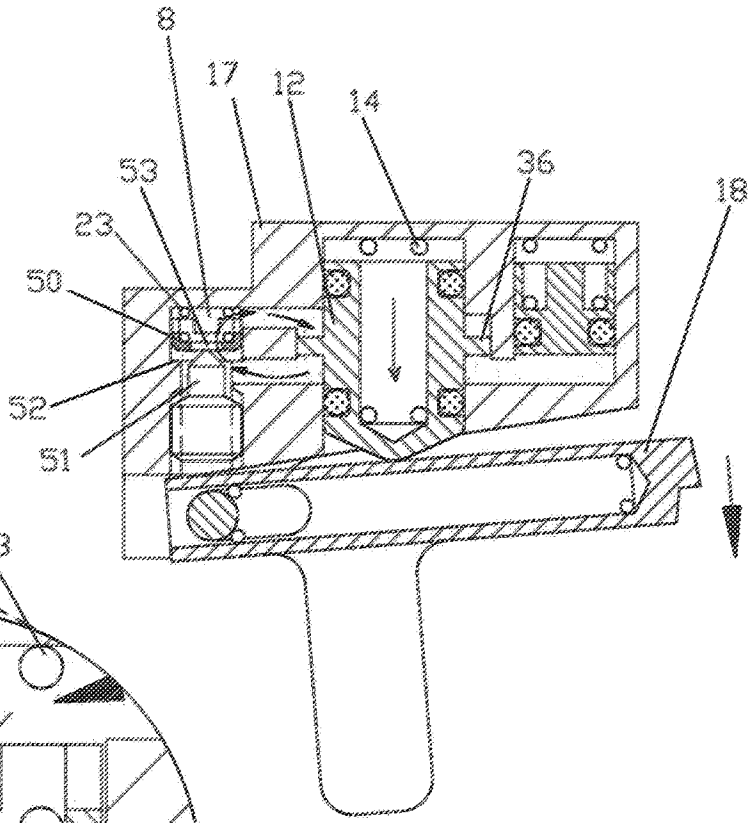
FIG. 19 illustrates the embodiment of FIG. 18 during repositioning of the sear.

Referring now to FIG. 19 which is the same embodiment as FIG. 18 except the hammer, (not shown) has been released from sear 18 so that piston spring 14 can force piston 12 and sear 18 downward to their starting positions. As piston 12 is moving downward, piston flange 36 of piston 12 has reversed the direction of fluid 8 flow, so that fluid 8 is moving upward through orifice 53. Since the pressure in upwardly flowing fluid 8 exceeds the force of valve spring 23, poppet 50 is lifted off valve seat 52, permitting fluid 8 to readily flow upward and return to above piston flange 36 of piston 12. Thus, the rate reducer will be ready to temporarily delay the hammer (not shown) for the next shot.

Needle valve 51 is threadedly engaged with rate reducer body 17 such that screwing needle valve 51 down will increase the clearance between orifice 53, of poppet 50, and needle valve 51. Conversely, screwing needle valve 51 up will decrease the clearance between needle valve 51 and poppet 50. As with valve 9 and valve seat 10 of the previous embodiment, the gap created between needle valve 51 and orifice 53 regulates the flow of fluid 8. The slower the flow of fluid 8, the longer the delay of release of hammer 31 and therefore the slower the cyclic firing rate.

A problem in designing a device to be added to existing mass-produced mechanisms is the necessity to accommodate the existing mechanism's design tolerances. That is, the new components must interact with mechanisms that were not originally intended for the new components. Additionally, wear resulting from normal use essentially increases the design tolerances.

Figure 20:
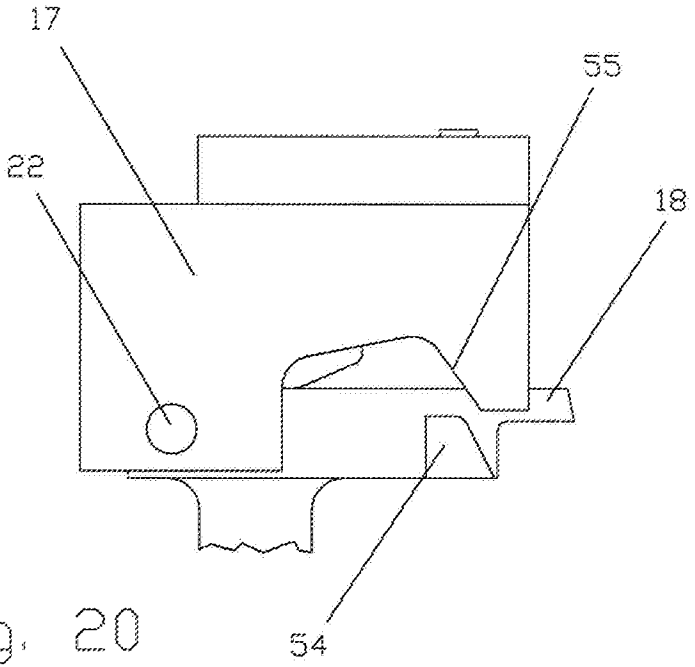
FIG. 20 illustrates a rate reducer as shown in the previous figures, but provided with an augmenting sear cam.

Referring now to FIG. 20 in which the solution to the above tolerance, allowance, and wear problems is introduced. Sear 18 of the rate reducer is provided with a sear lug 54. Rate reducer body 17 is provided with a cam 55. As in the other figures sear 18 is rotatable relative to pivot 22.

Figure 21:
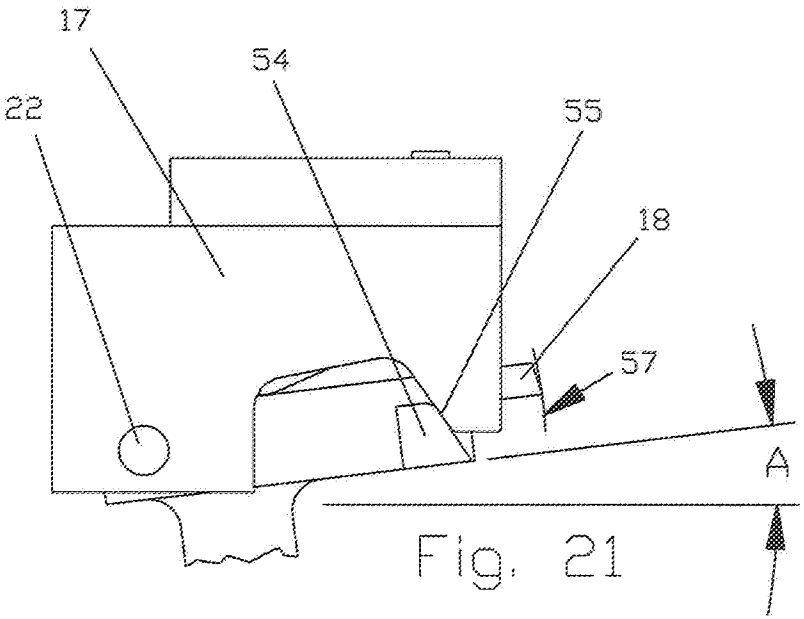
FIG. 21 illustrates the rate reducer of FIG. 20 with the sear partially rotated.

Referring now to FIG. 21 in which sear 18 has been rotated by the hammer (not shown) through angle "A." During rotation of sear 18 through angle "A" sear 18 follows arc 57. At the end of rotation of sear 18 through angle "A" sear lug 54 has come into contact with cam 55 of rate reducer body 17.

Figures 22, 23, 23A:
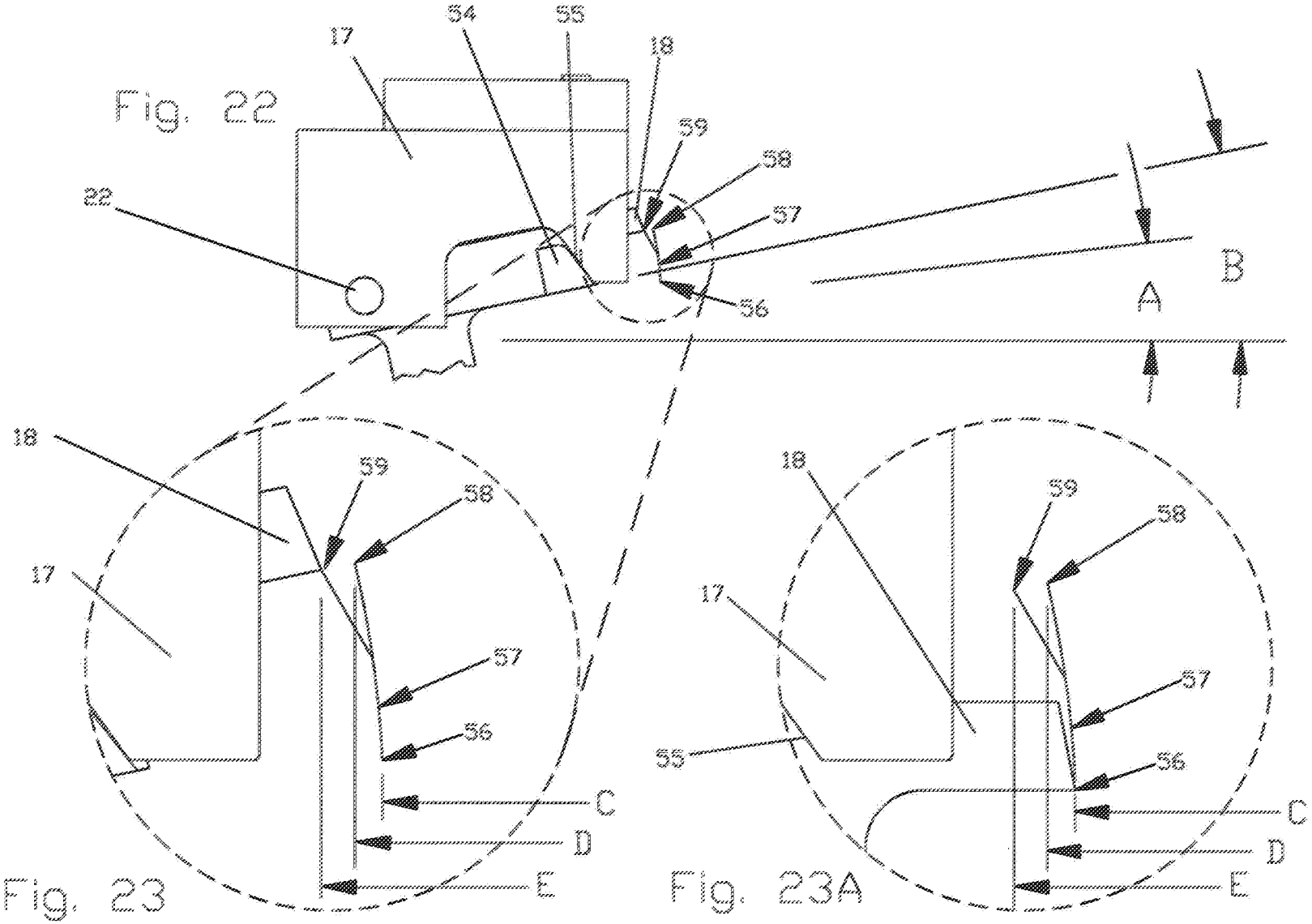
FIG. 22 illustrates the rate reducer of FIG. 20 with the sear fully rotated.
FIG. 23 is an enlarged view of a selected portion of FIG. 22.
FIG. 23A is like FIG. 23 except the sear is shown in its starting position as shown in FIG. 20.

Referring now to FIGS. 22 and 23 in which sear 18 has been rotated beyond angle "A," and through angle "B" by the hammer (not shown). Sear lug 54 has been forced rearward by sliding contact with cam 55 which has been set at an angle relative to the path of sear lug 54 to cause sear 18 to move horizontally rearward a greater distance than would have occurred if sear 18 had simply continued travelling along arc 57. That is, rather than allowing sear 18 to travel from arc starting point 56 to hypothetical arc terminus 58, sear lug 54, and cam 55 significantly increase the horizontal movement of sear 18, causing sear 18 to travel along the divergent cam path to cam terminus 59.

FIG. 23A is like FIG. 23 except sear 18 is shown in its starting position as indicated at position "C," and as also in FIG. 20. Positon "D" shows the hypothetical horizontal distance sear 18 would have traversed if sear 18 had not been displaced rearward to position "E" by the action of sear lug 54 being displaced by cam 55 of rate reducer body 17. It can be seen that the rearward displacement of sear 18 to position "E" is increased as a result of sear lug 54 interacting with cam 55. The design of the angle of cam 55 can be adjusted to achieve optimal displacement of sear 18 to a desired position corresponding to position "E."

Sear lug 54 and cam 55 can be applied to all rate reducers in all proceeding figures in order to accommodate design allowances, design tolerances, and normal wear occurring within the entire population of weapons for which the rate reducer is intended.

The augmentation of the rearward motion of sear 18 also serves the same purpose as the early release bypass feature in achieving uniform rate reduction, as illustrated in FIG. 13. The augmented rearward sear motion can be employed instead of, or in conjunction with, the bypass feature.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

LIST OF ELEMENTS

1 Rate reducer
2 Rifle
4 Issue automatic sear
5 Issue automatic sear pin
6 Screws
7. Automatic sear pin holes
8 Fluid
9 Valve
10 Valve seat
11 Valve adjusting screw
12 Piston
13 O-ring(s)
14 Piston spring
15 Plunger
16 Plunger spring
17 Rate reducer body
18 Sear
19 Sear spring
20 Lower receiver
21 Mounting hole(s)
22 Pivot
23 Valve spring
24 Reservoir
25 Inspection hole
26 Trigger/hammer contact
27 Hammer hook
28 Sear surface
29 Automatic sear notch
30 Sear projection
31 Hammer
32 Trigger nose
33 Trigger
34 Selector
35 Hammer pin
36 Piston flange
37 Selector/sear projection interface
38 Slot
39 Bypass
40 Port
41 Contact area
42 Plug
43 Cylinder bore
44 Reed valve
45 Metering hole
46 Elastomer
47 Cup
48 Elastomer cup spring
49 Arc
50 Poppet
51 Needle valve
52 Valve seat
53 Orifice
54 Sear lug
55 Cam
56 Arc start point
57 Arc
58 Arc terminus
59 Cam terminus

What is claimed is:

1. A mechanism for reducing or controlling a cyclic firing rate of a firearm, comprising a rate reducer including:

a reducer body with a pivot mount and an internal volume for housing a fluid, the reducer body including a valve for controlling a flow of the fluid within the internal volume in a first direction and in a second, reverse direction; and a sear pivotally mounted to and longitudinally movable along the pivot mount, wherein engagement of a hammer of the firearm with a forward end of the sear after firing a round from the firearm pivots the sear upwardly to initiate the flow of the fluid in the first direction through the valve to retard pivoting movement of the sear and maintain engagement between the hammer and the sear until the hammer is released from the sear, wherein:

the reducer body includes a piston that is biased into engagement with the sear, and the sear compresses the piston against a piston spring to initiate the flow of fluid in the first direction through the valve;

the hammer is released from the sear in response to displacement of the piston and piston spring to a compressed position;

at the compressed position of the piston and piston spring, the flow of fluid through the valve is reversed to the second direction and the piston displaces from the compressed position to force the sear to pivot downwardly around the pivot mount; and further comprising a sear spring to normally bias the sear forwardly relative to the pivot mount and the reducer body.

2. The mechanism of claim 1, wherein the fluid is one of a hydraulic fluid and a gas.

3. The mechanism of claim 1, further comprising a bypass cut in the reducer body that is located between the piston and the valve to provide a path for the flow of fluid in the first and second directions in addition to the valve.

4. The mechanism of claim 1, wherein the hammer rotates rearwardly after firing the round to displace the sear rearwardly along the pivot mount against the sear spring to allow the hammer past the forward end of the sear, and the sear spring displaces sear forwardly to engage a sear surface at the forward end of the sear with a hammer hook of the hammer to arrest the hammer and initiate the fluid flow in the first direction.

5. The mechanism of claim 1, wherein the valve is adjustable to control a rate of fluid flow in the first and second directions.

6. The mechanism of claim 5, wherein the reducer body includes a valve seat and a valve adjusting screw for adjusting a separation distance between the valve and the valve seat to infinitely adjust an allowable rate of fluid flow in the first and second directions.

7. The mechanism of claim 1, wherein the valve includes a reed valve with a metering hole for controlling a rate of the flow of fluid in the first direction.

8. The mechanism of claim 1, wherein the reducer body includes a port for visual inspection of the fluid in the internal volume.

9. The mechanism of claim 1, wherein the sear includes a lug and the reducer body includes a cam that contacts the lug during pivoting movement of the sear about the pivot mount to rearwardly and longitudinally displace the sear along the pivot mount.

10. A mechanism for reducing or controlling a cyclic firing rate of a firearm, comprising a rate reducer including:

a reducer body with a pivot mount and an internal volume for housing a fluid, the reducer body including a valve for controlling a flow of the fluid within the internal volume in a first direction and in a second, reverse direction; and a sear pivotally mounted to and longitudinally movable along the pivot mount, wherein engagement of a hammer of the firearm with a forward end of the sear after firing a round from the firearm pivots the sear upwardly to initiate the flow of the fluid in the first direction through the valve to retard pivoting movement of the sear and maintain engagement between the hammer and the sear until the hammer is released from the sear, wherein the valve is adjustable to control a rate of fluid flow in the first and second directions, wherein:

the valve includes an adjustable needle and a poppet supportable on a valve seat of the reducer body;

the poppet defines an orifice for receiving the adjustable needle; and the valve further includes a valve spring normally biasing the poppet against the valve seat.

11. The mechanism of claim 10, wherein the flow of fluid in the first and second directions occurs through the orifice of the poppet.

12. A mechanism for reducing or controlling a cyclic firing rate of a firearm, comprising a rate reducer including:

a reducer body with a pivot mount and an internal volume for housing a fluid, the reducer body including a valve for controlling a flow of the fluid within the internal volume in a first direction and in a second, reverse direction; and a sear pivotally mounted to and longitudinally movable along the pivot mount, wherein engagement of a hammer of the firearm with a forward end of the sear after firing a round from the firearm pivots the sear upwardly to initiate the flow of the fluid in the first direction through the valve to retard pivoting movement of the sear and maintain engagement between the hammer and the sear until the hammer is released from the sear, wherein the sear includes a downwardly extending sear projection that is contactable by a selector/sear projection interface of the firearm to rearwardly displace the sear and prevent engagement of the sear with the hammer during a safe or semi-automatic firing mode of the firearm.

13. The mechanism of claim 12, wherein the reducer body includes a piston that is biased into engagement with the sear, and the sear compresses the piston against a piston spring to initiate the flow of fluid in the first direction through the valve.

14. The mechanism of claim 13, wherein the hammer is released from the sear in response to displacement of the piston and piston spring to a compressed position.

15. The mechanism of claim 12, wherein the reducer body includes a port for visual inspection of the fluid in the internal volume.

16. A mechanism for reducing or controlling a cyclic firing rate of a firearm, comprising a rate reducer including:

a reducer body with a pivot mount and an internal volume for housing a fluid, the reducer body including a valve for controlling a flow of the fluid within the internal volume in a first direction and in a second, reverse direction; and a sear pivotally mounted to and longitudinally movable along the pivot mount, wherein engagement of a hammer of the firearm with a forward end of the sear after firing a round from the firearm pivots the sear upwardly to initiate the flow of the fluid in the first direction through the valve to retard pivoting movement of the sear and maintain engagement between the hammer and the sear until the hammer is released from the sear, wherein the reducer body is engageable to a lower receiver of the firearm with attachment means in mounting holes of the firearm provided for an automatic sear of the firearm that is replaced by the rate reducer.

17. The mechanism of claim 16, wherein the reducer body includes a port for visual inspection of the fluid in the internal volume.

18. The mechanism of claim 16, wherein the valve is adjustable to control a rate of fluid flow in the first and second directions.

19. The mechanism of claim 18, wherein the reducer body includes a valve seat and a valve adjusting screw for adjusting a separation distance between the valve and the valve seat to infinitely adjust an allowable rate of fluid flow in the first and second directions.

20. The mechanism of claim 18, wherein the valve includes an adjustable needle and a poppet supportable on a valve seat of the reducer body, wherein the poppet defines an orifice for receiving the adjustable needle, and the valve further includes a valve spring normally biasing the poppet against the valve seat.

* * * * *